United States Patent [19]

Oerth

[11] 4,230,936

[45] Oct. 28, 1980

[54] BIORHYTHMIC SLIDE RULE

[76] Inventor: Daniel P. Oerth, 10124 Rosin Ave., Whittier, Calif. 90603

[21] Appl. No.: 878,708

[22] Filed: Feb. 17, 1978

[51] Int. Cl.[3] ..... G06G 1/06

[52] U.S. Cl. ..... 235/70 A; 235/85 FC

[58] Field of Search ..... 235/70 A, 70 R, 89 R, 235/85 FC, 61 B

[56] References Cited

U.S. PATENT DOCUMENTS

| | | | |
|---|---|---|---|
| 2,434,306 | 1/1948 | Wood | 235/70 R |
| 2,594,857 | 4/1952 | Boos | 235/70 R |
| 3,853,265 | 12/1974 | Kunert | 235/70 R |
| 4,035,616 | 7/1977 | Piringer | 235/89 R |

FOREIGN PATENT DOCUMENTS

| | | | |
|---|---|---|---|
| 339758 | 9/1959 | Switzerland | 235/70 A |

*Primary Examiner*—L. T. Hix
*Assistant Examiner*—Benjamin R. Fuller
*Attorney, Agent, or Firm*—Jack C. Munro

[57] ABSTRACT

A biorhythmic slide rule which includes three separate movable slides wherein each slide includes different biorhythmic indicia. The slides are positionable in an overlying relationship with the indicia of all three of the slides being observable permitting a coordinated assemblage of the indica.

3 Claims, 4 Drawing Figures

BIORHYTHMIC SLIDE RULE

BACKGROUND OF THE INVENTION

There is a well known theory that the lives of human beings are controlled by three different rhythms. These rhythms are defined as the physical, emotional and intellectual. Each rhythm has a definite time period with the physical being twenty-three days long, the emotional rhythm being twenty-eight days long and the intellectual rhythm being thirty-three days long. Each of these rhythms can be represented in the form of a specific sine curve.

For each rhythm there is a positive region and a negative region. The positive region is equal in time to the negative region. Therefore, for the physical rhythm there is eleven and one half days positive and eleven and one half days negative. Similarly, the emotional rhythm period is fourteen days positive and fourteen days negative with the intellectual rhythm period being sixteen and one half days positive and sixteen and one half days negative.

During the positive half cycles people are supposedly well coordinated, quick and sure in reactions, in excellent control of emotions, able to cope with difficult situations, mentally sharp, best able to solve difficult problems and far less prone to mental errors. During the negative half cycles the opposite is true in each case; coordination is diminished, reaction time is slow, people tend to panic in difficult situations and people are much more prone to bad moods, tend to be edgy and are much more likely to lose tempers, are mentally unresponsive and more error prone than usual.

The days when the cycles pass from one phase to another (positive to negative or negative to positive) are deemed to be critical days. Accidents occur with far greater frequency on days that are critical, especially in the physical and emotional rhythms. Alledgedly this ratio is about four to one. Stated differently, eighty percent of all accidents occur on physical and emotionally critical days which comprise only fifteen percent of all days.

This biorhythm concept is used by a wide range of different types of individuals. For example, the concept is currently being used within certain police departments to discover what days the policemen are more prone to accidents or potential injury. Salesmen use the biorhythm concept to plan important meetings on their most favorable days. Doctors and their patients can select the best days for elective surgery. Everyone can be extra cautious on critical days since people now have the ability to know in advance what the condition will be on a particular day. Vacations can be planned for favorable periods. In short, knowledge of biorhythms can improve an individuals life.

Previously there have been biorhythmic devices to ascertain a persons biorhythmic situation. Since there are three separate biorhythms and these biorhythms must be correlated with each other in a particular arrangement, the previous type of devices have been quite complex to operate in order to derive the biorhythmic knowledge of a particular individual for a particular day. Not only is there the three variables of the three separate thythms, there is also the substantial number of variables in that the calculation depends on the individuals specific birth day.

At the present time there have been available devices to calculate the biorhythmic information for a particular individual on a given day. There has been no known easy way to display the biorhythmic information for a particular individual over an extended period of time, such as for an entire year. The displaying for an extended period of time has certain advantages in that the individual can note not only the critical days but also can denote subtle changes in the biorhythm pattern which may prove to be helpful depending on the activities of the individual.

SUMMARY OF THE INVENTION

The structure of this invention and its use is difficult to summarily describe. Therefore, reference is to be had to detailed description which follows further on in the specification.

A primary objective of this invention is to construct a device which can be used by a relatively unskilled and unknowledgable person to ascertain his own biorhythm pattern or any biorhythm pattern of anyone that he so chooses once the individuals specific birth date is known.

A further objective of this invention is to display an individuals biorhythmic pattern for an extended period of time such as for a year and that an individual can in one quick observation note the biorhythmic pattern at any specific day within the year.

It is a further objective of this invention to construct the device in such a manner as to minimize manufacturing cost therefore keeping the selling price as low as possible.

DETAILED DESCRIPTION OF THE SHOWN EMBODIMENT

Figures 1, 2, 3, 4:
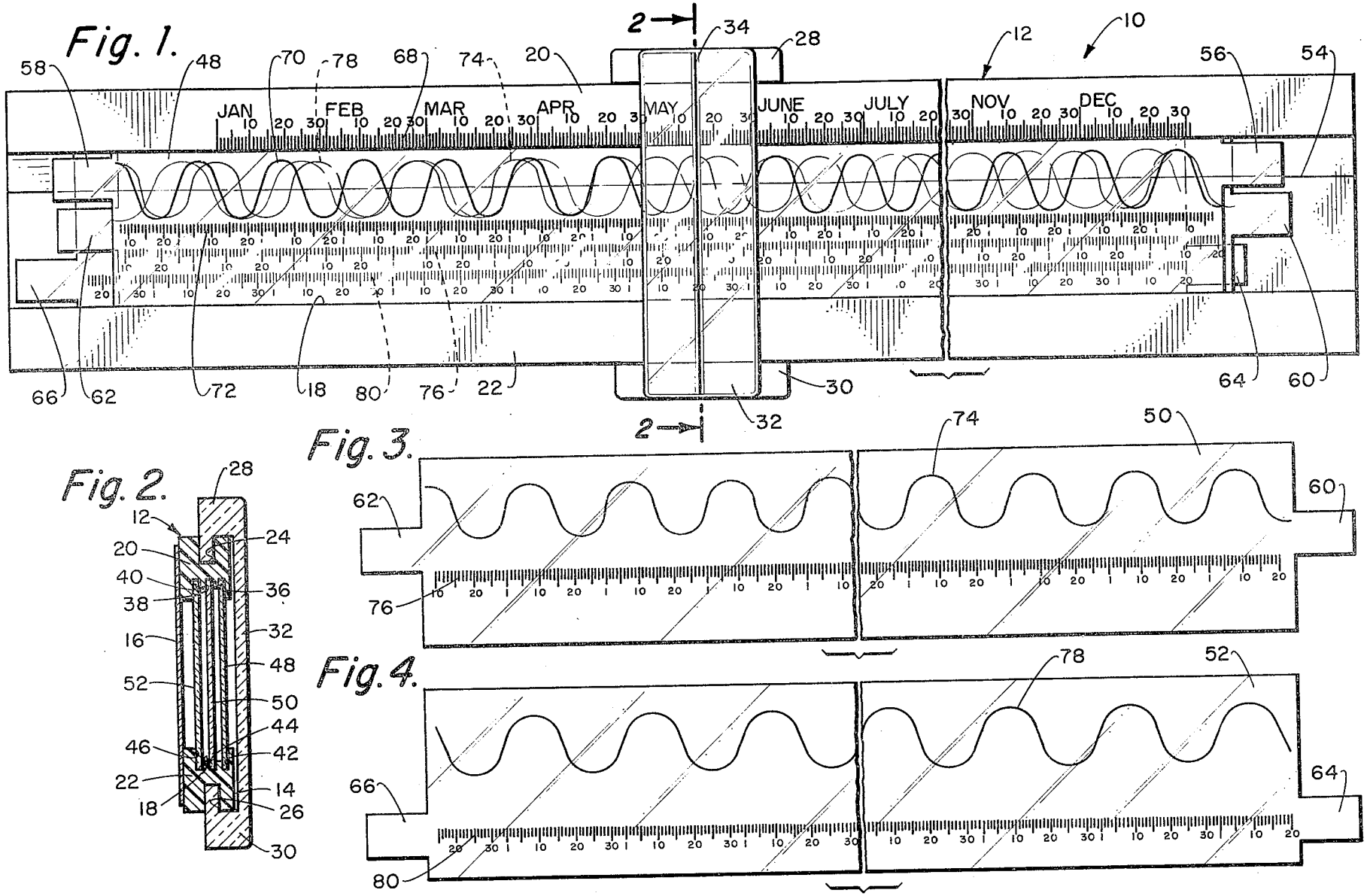
FIG. 1 is a front elevational view of the assembled biorhythmic slide rule of this invention.
FIG. 2 is a cross-sectional view taken along line 2—2 of FIG. 1.
FIGS. 3 and 4 are front elevational views of different types of biorhythmic slides employed within the biorhythmic slide rule of this invention.

The biorhythmic slide rule 10 of this invention takes the form of a housing 12 which has a front side 14 and a back side 16. The front side 14 includes an enlarged elongated opening 18. A back side 16 is formed into a solid member located between an upper end member 20 and a lower end member 22. The upper end member 20 includes an elongated recess 24 formed within the exterior surface of the member 20. A similar recess 26 is formed within the exterior surface of the lower member 22. The recess 24 is to cooperate with a runner 28 with the recess 26 cooperating with the runner 30. The runners 28 and 30 are integrally connected together through the use of a front panel 32. The runners 28 and 30 are to be slidably movable within their respective recesses 24 and 26. The front panel 32 is formed basically transparent with the exception of a longitudinal, straight hairline 34 which extends across a housing 12 from upper end 20 to lower end 22. It is to be noted that the hairline 34 is located perpendicular to the longitudinal center axis of the opening 18.

The interior wall of the end 20 which connects with the opening 18 includes elongated channels 36,38 and 40. Similarly the wall surface of the end 22 which connects with the opening 18 is formed to include the elongated separate parallel recesses 42, 44 and 46.

The recesses 42 and 36 cooperate together to retain a first slide 48. The recesses 44 and 38 cooperate together to slideably retain a second slide 50. Recesses 46 and 40 cooperate together to slideably retain a third slide 52. The slides 48, 50 and 52 are all individually slideable within their respective cooperating recesses. The slides 48, 50 and 52 are located in a parallel overlying relationship and are also positioned parallel to the surface of the member 32.

On the interior surface of the back side 16 is located a elongated straight line 54. The purpose of the line 54 will be explained further on in this specification.

The slides 48, 50 and 52 are formed substantially transparent and will normally be constructed of a plastic material. At each end of the slide 48 is located extending members 56 and 58, respectively. Similarly, extending members 60 and 62 are attached at each end of slide 50. And also similar extending members 64 and 66 are attached at opposite ends of the slide 52. With the slides 48, 50 and 52 located at an overlying relationship with respect to each other and similarly members 58, 62 and 66 are located in a staggered relationship in respect to each other. The purpose of the members 56, 58, 60, 62, 64 and 66 is to facilitate separate sliding movement of each of the slides 48, 50 and 52 within the housing 12.

Within the front surface 14 of the upper member 20 is imprinted thereon indicia 68 in the form of a calender. Indicia 68 includes representations for each month of the year and separate individual divisions for each day in each month. These divisions for each day is denoted by a small mark or line. The hairline 34 is capable of being located upon any given mark of the indicia 68.

The slide 48 includes a first opaque sine wave 70 as well as numerical indicia 72. The sine wave 70 is to represent the physical biorhythmic cycle with the indicia 72 comprising a longitudinal sequence of small lines or marks finding an upper limit of twenty-three days which is to represent a complete full cycle of the sine wave 70. After the upper limit of twenty-three days is reached, the numerical indicia 70 then continues to repeat itself. Normally, a sine wave 70 as well as the indicia 72 will be of a particular color such as red.

Located upon the slide 50 is a second sine wave 74 and second numerical indicia 76. The sine wave 74 represents the emotional biorhythm having a cycle of twenty-eitht days and the numerical indicia 76 repeating itself upon reaching the upper limit of twenty-eight.

In a similar manner the slide 52 includes a third sine wave 78 and the third type of numerical indicia 80. The repeating cycle for the wave 78 is thirty-three days which is denoted by the thirty-three separate marks of the indicia 80.

It is to be noted that the spacing between the marks of indicia 80 as well as the spacing between the marks of indicia 76 as well as the spacing between the marks of indicia 72 as well as the spacing between the marks of indicia 68 are all the same. This is necessary in order to achieve the intercorrelation between the different biorhythmic curves represented by sine wave curves 70, 74 and 78.

With the slides 48, 50 and 52 located as shown in FIGS. 1 and 2, the sine wave curves 70, 74 and 78 are interposed one on top of each other so that the individual can readily distinguish one sine wave curve with respect to the other as well as the different type of indicia, the indicia on slide 48 is colored red and the indicia on slide 50 is colored blue with the indicia on slide 52 being colored green. Also to be noted that the numerical indicias 72, 76 and 80 are positioned to be observed separately and not located directly one on top of each other.

In the employing of the device 10 of this invention, the following procedure is employed: Reference is to be had to the following Table Selection Chart

TABLE SELECTION CHART

| | | | | | | | | | YEAR OF BIRTH | | | |
|---|---|---|---|---|---|---|---|---|---|---|---|---|
| | | | | | | | | | 1896 | 1897 | 1898 | 1899 |
| | | | | | | | | | 1900 | 1901 | 1902 | 1903 |
| | | | | | | | | | 1904 | 1905 | 1906 | 1907 |
| | | | | | | | | | 1908 | 1909 | 1910 | 1911 |
| | | | | | | | | | 1912 | 1913 | 1914 | 1915 |
| | | | | | | | | | 1916 | 1917 | 1918 | 1919 |
| | | | | | | | | | 1920 | 1921 | 1922 | 1923 |
| | | | | | | | | | 1924 | 1925 | 1926 | 1927 |
| | | | | | | | | | 1928 | 1929 | 1930 | 1931 |
| | | | | | | | | | 1932 | 1933 | 1934 | 1935 |
| | | | | | | | | | 1936 | 1937 | 1938 | 1939 |
| | | | | | | | | | 1940 | 1941 | 1942 | 1943 |
| | | | | | | | | | 1944 | 1945 | 1946 | 1947 |
| | | | | | | | | | 1948 | 1949 | 1950 | 1951 |
| | | | | | | | | | 1952 | 1953 | 1954 | 1955 |
| | | | | | | | | | 1956 | 1957 | 1958 | 1959 |
| | | | | | | | | | 1960 | 1961 | 1962 | 1963 |
| | | | | | | | | | 1964 | 1965 | 1966 | 1967 |
| | | | | | | | | | 1968 | 1969 | 1970 | 1971 |
| | | | | | | | | | 1972 | 1973 | 1974 | 1975 |
| | | | | | | | | | 1976 | 1977 | 1978 | 1979 |
| | | | | | | | | | 1980 | 1981 | 1982 | 1983 |
| | | | | | | | | | 1984 | 1985 | 1986 | 1987 |
| AGE ON BIRTHDAY | 1 | 13 | 25 | 37 | 49 | 61 | 73 | 85 | 2 | | | 1 |
| THIS YEAR | 5 | 17 | 29 | 41 | 53 | 65 | 77 | 89 | | 1 | 1 | |
| | 9 | 21 | 33 | 45 | 57 | 69 | 81 | 93 | 1 | | | 2 |
| | 2 | 14 | 26 | 38 | 50 | 62 | 74 | 86 | 2 | | 1 | |
| | 6 | 18 | 30 | 42 | 54 | 66 | 78 | 90 | | 1 | | 2 |
| | 10 | 22 | 34 | 46 | 58 | 70 | 82 | 94 | 1 | | 2 | |
| | 3 | 15 | 27 | 39 | 51 | 63 | 75 | 87 | 2 | 1 | | |
| | 7 | 19 | 31 | 43 | 55 | 67 | 79 | 91 | | | 2 | 2 |
| | 11 | 23 | 35 | 47 | 59 | 71 | 83 | 95 | 1 | 2 | | |
| | 4 | 16 | 28 | 40 | 52 | 64 | 76 | 88 | | | | |
| | 8 | 20 | 32 | 44 | 56 | 68 | 80 | 92 | 1 | 1 | 1 | 1 |

TABLE SELECTION CHART-continued

| | | | | | | | |
|---|---|---|---|---|---|---|---|
| 12 | 24 | 36 | 48 | 60 | 72 | 84 | 96 |

The individual's year of birth is determined in the appropriate vertical column of the table selection chart. The age of the individual's birthday for the present year is determined within the appropriate row of the Table Selection Chart. Where the particular row intersects with the particular column, there is a numeral. Where there is two numerals, the upper number is used if the person's birthday is on or before February 28.

The person then is to be referred to a pair of tables according to which number has been selected by the Table Selection Chart. These tables are represented as follows:

TABLE 1

| Age | P | E | I |
|---|---|---|---|
| 1 | 21 | 2 | 3 |
| 2 | 18 | 3 | 5 |
| 3 | 15 | 4 | 7 |
| 4 | 13 | 6 | 10 |
| 5 | 10 | 7 | 12 |
| 6 | 7 | 8 | 14 |
| 7 | 4 | 9 | 16 |
| 8 | 2 | 11 | 19 |
| 9 | 22 | 12 | 21 |
| 10 | 19 | 13 | 23 |
| 11 | 16 | 14 | 25 |
| 12 | 14 | 16 | 28 |
| 13 | 11 | 17 | 30 |
| 14 | 8 | 18 | 32 |
| 15 | 5 | 19 | 1 |
| 16 | 3 | 21 | 4 |
| 17 | 23 | 22 | 6 |
| 18 | 20 | 23 | 8 |
| 19 | 17 | 24 | 10 |
| 20 | 15 | 26 | 13 |
| 21 | 12 | 27 | 15 |
| 22 | 9 | 28 | 17 |
| 23 | 6 | 1 | 19 |
| 24 | 4 | 3 | 22 |
| 25 | 1 | 4 | 24 |
| 26 | 21 | 5 | 26 |
| 27 | 18 | 6 | 28 |
| 28 | 16 | 8 | 31 |
| 29 | 13 | 9 | 33 |
| 30 | 10 | 10 | 2 |
| 31 | 7 | 11 | 4 |
| 32 | 5 | 13 | 7 |
| 33 | 2 | 14 | 9 |
| 34 | 22 | 15 | 11 |
| 35 | 19 | 16 | 13 |
| 36 | 17 | 18 | 16 |
| 37 | 14 | 19 | 18 |
| 38 | 11 | 20 | 20 |
| 39 | 8 | 21 | 22 |
| 40 | 6 | 23 | 25 |
| 41 | 3 | 24 | 27 |
| 42 | 23 | 25 | 29 |
| 43 | 20 | 26 | 31 |
| 44 | 18 | 28 | 1 |
| 45 | 15 | 1 | 3 |
| 46 | 12 | 2 | 5 |
| 47 | 9 | 3 | 7 |
| 48 | 7 | 5 | 10 |
| 49 | 4 | 6 | 12 |
| 50 | 1 | 7 | 14 |
| 51 | 21 | 8 | 16 |
| 52 | 19 | 10 | 19 |
| 53 | 16 | 11 | 21 |
| 54 | 13 | 12 | 23 |
| 55 | 10 | 13 | 25 |
| 56 | 8 | 15 | 28 |
| 57 | 5 | 16 | 30 |
| 58 | 2 | 17 | 32 |
| 59 | 22 | 18 | 1 |
| 60 | 20 | 20 | 4 |
| 61 | 17 | 21 | 6 |

TABLE 1-continued

| Age | P | E | I |
|---|---|---|---|
| 62 | 14 | 22 | 8 |
| 63 | 11 | 23 | 10 |
| 64 | 9 | 25 | 13 |
| 65 | 6 | 26 | 15 |
| 66 | 3 | 27 | 17 |
| 67 | 23 | 28 | 19 |
| 68 | 21 | 2 | 22 |
| 69 | 18 | 3 | 24 |
| 70 | 15 | 4 | 26 |
| 71 | 12 | 5 | 28 |
| 72 | 10 | 7 | 31 |
| 73 | 7 | 8 | 33 |
| 74 | 4 | 9 | 2 |
| 75 | 1 | 10 | 4 |
| 76 | 22 | 12 | 7 |
| 77 | 19 | 13 | 9 |
| 78 | 16 | 14 | 11 |
| 79 | 13 | 15 | 13 |
| 80 | 11 | 17 | 16 |

TABLE 2

| Age | P | E | I |
|---|---|---|---|
| 1 | 22 | 3 | 4 |
| 2 | 19 | 4 | 6 |
| 3 | 16 | 5 | 8 |
| 4 | 14 | 7 | 11 |
| 5 | 11 | 8 | 13 |
| 6 | 8 | 9 | 15 |
| 7 | 5 | 10 | 17 |
| 8 | 3 | 12 | 20 |
| 9 | 23 | 13 | 22 |
| 10 | 20 | 14 | 24 |
| 11 | 17 | 15 | 26 |
| 12 | 15 | 17 | 29 |
| 13 | 12 | 18 | 31 |
| 14 | 9 | 19 | 33 |
| 15 | 6 | 20 | 2 |
| 16 | 4 | 22 | 5 |
| 17 | 1 | 23 | 7 |
| 18 | 21 | 24 | 9 |
| 19 | 18 | 25 | 11 |
| 20 | 16 | 27 | 14 |
| 21 | 13 | 28 | 16 |
| 22 | 10 | 1 | 18 |
| 23 | 7 | 2 | 20 |
| 24 | 5 | 4 | 23 |
| 25 | 2 | 5 | 25 |
| 26 | 22 | 6 | 27 |
| 27 | 19 | 7 | 29 |
| 28 | 17 | 9 | 32 |
| 29 | 14 | 10 | 1 |
| 30 | 11 | 11 | 3 |
| 31 | 8 | 12 | 5 |
| 32 | 6 | 14 | 8 |
| 33 | 3 | 15 | 10 |
| 34 | 23 | 16 | 12 |
| 35 | 20 | 17 | 14 |
| 36 | 18 | 19 | 17 |
| 37 | 15 | 20 | 19 |
| 38 | 12 | 21 | 21 |
| 39 | 9 | 22 | 23 |
| 40 | 7 | 24 | 26 |
| 41 | 4 | 25 | 28 |
| 42 | 1 | 26 | 30 |
| 43 | 21 | 27 | 32 |
| 44 | 19 | 1 | 2 |
| 45 | 16 | 2 | 4 |
| 46 | 13 | 3 | 6 |
| 47 | 10 | 4 | 8 |
| 48 | 8 | 6 | 11 |
| 49 | 5 | 7 | 13 |
| 50 | 2 | 8 | 15 |
| 51 | 22 | 9 | 17 |

TABLE 2-continued

| Age | P | E | I |
|---|---|---|---|
| 52 | 20 | 11 | 20 |
| 53 | 17 | 12 | 22 |
| 54 | 14 | 13 | 24 |
| 55 | 11 | 14 | 26 |
| 56 | 9 | 16 | 29 |
| 57 | 6 | 17 | 31 |
| 58 | 3 | 18 | 33 |
| 59 | 23 | 19 | 2 |
| 60 | 21 | 21 | 5 |
| 61 | 18 | 22 | 7 |
| 62 | 15 | 23 | 9 |
| 63 | 12 | 24 | 11 |
| 64 | 10 | 26 | 14 |
| 65 | 7 | 27 | 16 |
| 66 | 4 | 28 | 18 |
| 67 | 1 | 1 | 20 |
| 68 | 22 | 3 | 23 |
| 69 | 19 | 4 | 25 |
| 70 | 16 | 5 | 27 |
| 71 | 13 | 6 | 29 |
| 72 | 11 | 8 | 32 |
| 73 | 8 | 9 | 1 |
| 74 | 5 | 10 | 3 |
| 75 | 2 | 11 | 5 |
| 76 | 23 | 13 | 8 |
| 77 | 20 | 14 | 10 |
| 78 | 17 | 15 | 12 |
| 79 | 14 | 16 | 14 |
| 80 | 12 | 18 | 17 |

By using the individual's age within the appropriate table a series of three numbers is determined. These numbers are then used to establish the setting of each of the slides 48, 50 and 52 with respect to the numerical indicia 68.

By way of an example it is wished to establish the biorhythm numerals for a person born on May 15, 1955. Assuming the present year to be 1978, the subject will be twenty-three years old on his birthday. The hairline 34 is then moved to the birth date within the numerical indicia 68.

Next, within the Table Selection Chart, the year 1955 is noted within the last vertical column. The age twenty-three is noted within the appropriate horizontal row and where the column and the row meet the number two is found indicating that Table 2 must be employed. From Table 2 besides the age of twenty-three the three separate settings are noted: Physical "P"-7. Emotional (E)-2 and Intellectual (I)-20.

Returning to the front side 14 of the slide rule 10, the slides 48, 50 and 52 are moved to bring the indicated number for each slide in alignment with the hairline 34. In other words within the slide 48, the hairline 34 is positioned at a numeral 7 with the slide 50 being positioned so that a numeral 2 is in alignment with the hairline 34 and within the slide 52 the hairline 34 is located in alignment with a numeral 20. It is to be noted that these numerals are repeated several times within the indicias 72, 76 and 80 with location at any one of the numerals being satisfactory.

Since the hairline 34 has been previously prelocated at the person's birthday within the indicia 68, the entire biorhythmatic pattern for the particular individual has been established and can be observed for an entire year by the simultaneous observation of the overlying sine wave curves 70, 74 and 78. The interelationship between the curves is of value especially when taken in conjunction with the line 54. The line 54 represents the zero position of each of the curves (the line between the positive and the negative). Where each of the curves cross the line 54 is to be termed a "critical day".

What is claimed is:

1. A biorhythmic slide rule comprising:

a housing having a guide track assembly, said guide track assembly comprising three (in number) separate adjacent parallel guide tracks, there being a separate said slide located within a separate said track, said housing having a front side, a first sequential indicia located on said front side;

a member movably mounted on said housing, said member having a thin hairline the longitudinal axis of which is located transverse to the longitudinal arrangement of said first indicia;

a first substantially transparent slide and a second substantially transparent slide and a third substantially transparent slide being movably mounted within said guide track assembly, each said slide including a different opaque sine wave curve, said sine wave curve being observable through said front side of said housing in an overlying relationship, each said slide having a sequential series of numerical indicia arranged adjacent its respective said sine wave curve, each said numerical indicia having an established upper limit correlated to its respective said sine wave curve with said upper limits being different, each said numerical indicia comprising a series of opaque evenly spaced apart first marks, the spacing between each of said first marks being identical for each said numerical indicia, said hairline to be alignable with said first mark of each said numerical indicia; and handle means attached to each said slide to facilitate sliding movement and positioning of each said slide within its said guide track assembly, said handle means comprises a longitudinal extending member located at each longitudinal end of each said slide, with said slide located in an overlying relationship the said extending members at each said end being located in a staggered relationship in respect to each other.

2. The biorhythmic slide rule as defined in claim 1 wherein:

said first sequential indicia comprising a series of evenly spaced apart second marks arranged lineally across said housing with each said second mark representing a different day in a year and there being a mark for each said day, said hairline to be alignable with any one of said second marks.

3. The biorhythmic slide rule as defined in claim 1 wherein:

each said different opaque sine wave curve being of a different color.

* * * * *